US005402758A

United States Patent [19]

Land et al.

[11] Patent Number: 5,402,758

[45] Date of Patent: Apr. 4, 1995

[54] STARTER PROTECTION DEVICE

[75] Inventors: Klaus Land, Denkendorf; Roland Glueck, Ludwigsburg; Werner Uebele, Rudersberg; Helmut Wassler, Stuttgart, all of Germany

[73] Assignee: Mercedes-Benz AG, Germany

[21] Appl. No.: 182,546

[22] Filed: Jan. 18, 1994

[30] Foreign Application Priority Data

Jan. 16, 1993 [DE] Germany ..... 43 01 067.9

[51] Int. Cl.[6] ..... F02N 11/08; F02N 11/10

[52] U.S. Cl. ..... 123/179.3; 290/38 R

[58] Field of Search ..... 123/179.3, 179.25, 179.1; 290/38 R, 38 C

[56] References Cited

U.S. PATENT DOCUMENTS 3,857,043 12/1974 Habasch ..... 123/179.3
4,415,812 11/1983 Griffith et al. ..... 290/38 R

FOREIGN PATENT DOCUMENTS 1022053 1/1958 Germany .
2208045 8/1973 Germany .
2620988 11/1976 Germany .
62-162773 7/1987 Japan .
63-302174 12/1988 Japan .
888357 1/1962 United Kingdom .

OTHER PUBLICATIONS

Bosch, Technische Unterrichtung: Startanlagen, 1984, pp. 2–3, 6–9, 12–17, 19–21 and 32–33 (month unknown).

*Primary Examiner*—Andrew M. Dolinar
*Attorney, Agent, or Firm*—Evenson, McKeown, Edwards & Lenahan

[57] ABSTRACT

A starter is provided with a device for protecting an internal combustion engine against damage resulting from rapid repeated starting. The device holds the starter pinion meshed in the ring gear after an aborted attempt at starting and, after the starter switch is opened and the main current supply to the starter motor is disconnected, for as long as a voltage which is induced by the rotation of the armature shaft of the coasting starter motor flows through the device. The protection device can consist of a winding which is connected to the exciter winding of the starter motor. When current flows through the winding, a stop armature is extended and counteracts an unmeshing movement of the pinion.

3 Claims, 2 Drawing Sheets

STARTER PROTECTION DEVICE

BACKGROUND AND SUMMARY OF THE INVENTION

The present invention relates to a starter with a protection device, and more particularly, to a starter with an electric protection device for protecting an internal combustion engine against damage resulting from rapid repeated starting. A starter switch initiates a starting process, in the course of which a pinion is advanced on the armature shaft of an electric starter motor by an engagement relay and is meshed into a ring gear of the internal combustion engine. A contact bridge for supplying main current to the starter motor is closed by a meshing armature of the engagement relay. The protection device is supplied, after an aborted attempt at starting, that is to say when the starter switch is opened and the main current supply of the starter motor is disconnected, by a voltage which is induced by the rotation of the armature shaft of the coasting starter motor.

Internal combustion engines, in particular engines for motor vehicles, have to be started by a starter since they cannot start under their own power as can electric motors. The starter must rotate the internal combustion engine at a minimum starting speed of revolution and, after the first ignitions, support the engine as it runs up to the minimum independent speed of revolution. The considerable resistances of sealing, piston friction and bearing friction have to be overcome. Electric D.C. series-wound motors are preferably used as starters since they develop the required initial torque. The torque is transmitted to the flywheel on the crankshaft of the internal combustion engine via a pinion and a ring gear. As soon as the internal combustion engine starts and accelerates beyond the starting speed of revolution under its own power, the connection between starter shaft and crankshaft must be automatically eliminated in order to protect the starter, and the pinion must be unmeshed. Therefore, starters are equipped with a freewheel, and a meshing and return mechanism.

The high degree of stressing of the starter when the pinion is meshed into the ring gear leads to damage to the ring gear in the event of incorrect operation. Two possible types of incorrect operation are to be noted as causes.

A first cause is rapid repeated starting after a false start. That is, as a result of rapid repeated starting, after a preceding unsuccessful attempt at starting, the coasting pinion strikes the already stationary starter ring gear and therefore cannot mesh. The result is mechanical abrasion of the teeth with typical damage to the ring gear. The abrasion can be seen at the 2 swing-out positions in the case of the 4-cylinder engine or the 3 swing-out positions in the case of the 6-cylinder engine.

A second cause is repeated starting when the engine is already running. That is, if the driver has not noticed that the engine has started and attempts restarting, the pinion strikes the rotating ring gear and cannot mesh. The result is equally typical damage in which the abrasion is distributed over the entire circumference of the ring gear.

A conventional starter with a protection device is shown in DE-Z: BOSCH, Technische Unterrichtung: Startanlagen (Technical instruction aid: Starting systems, 1984, pp. 9 and 32) in which a start-blocking relay prevents the starter motor being switched on when the engine is running or coasting after a false start. Repeated starting is not possible until an integrated blocking time has elapsed. The start-blocking relay operates as a function of the voltage of a current generator or of a tacho-generator.

A further protection device is disclosed in DE-A 2 208 045 in which a voltage brought about by the rotation of the armature shaft of the starter motor is additionally evaluated. This voltage can be generated inductively for example in an auxiliary winding or in the case of a series-wound D.C. motor in the exciter winding by the rotation of the armature shaft. The voltage increases with the speed of revolution of the armature shaft and is connected to the input of a threshold-value switch which switches off the starter motor when the minimum independent speed of revolution of the internal combustion engine is reached. In order to prevent, after a false start, the pinion being meshed into the ring gear when the starter motor is still coasting, a blocking time which is determined by a capacitor, within which time an attempt at starting is ignored, is provided as in the case of the start-blocking relay already mentioned above.

Both of these known protection devices are capable of preventing damage to the ring gear and to the pinion which is caused by the two incorrect operations explained above. However, these protection devices are complex and expensive due to the large number of relays and components used in their construction. Since they are made as a separate module which is separated from the starter motor, they also require increased cabling outlay, as well as additional feedlines from the generator or rev-counter and, if appropriate from an auxiliary winding in the starter motor. This outlay is acceptable if the starting process cannot be reliably perceived audibly, for example in utility vehicles with underframe-mounted or rear-mounted engine.

The avoidance of damage resulting from excessively rapid repeated starting after a false start is a prime consideration especially for passenger cars, since the starting process can be monitored acoustically and repeated starting therefore occurs less-frequently when the engine is already running. A starter with a simple protection device which performs this function is described in the JP Abstract 63-302174 (A), M-809 4 Apr. 1989 in which the blocking time for repeated starting is controlled by a voltage which is induced by the coasting of the armature shaft. For this purpose, the protection device is supplied, after an aborted or unsuccessful attempt at starting and, in the process, disconnected main power supply of the starter motor, by a voltage which is induced by the rotation of the armature shaft of the coasting starter motor. As long as the armature shaft coasts and a voltage is applied to the protection device, a contact bridge in the main current supply line remains opened so that repeated starting cannot occur. A disadvantage of this known protection device is the comparatively long blocking time resulting from the coasting time of the starter motor and a requirement of an additional current switching relay to disconnect the main current supply.

An object of the present invention is to provide a starter with a simple and cost-effective protection device which permits rapid repeated starting after a false start and at the same time ensures that the pinion is at rest during engagement.

This object has been achieved in accordance with the present invention by providing a system after an aborted attempt at starting, the pinion meshed in the ring gear for as long as the protection device is supplied by the voltage induced by the rotation of the coasting armature shaft, with the contact bridge remaining disconnected.

The present invention uses the starter motor as a generator after an aborted start and disconnected main current supply with the coasting starter motor in order to feed a protection device with the induced voltage. The device keeps the pinion in engagement with the ring gear for the coasting time. As a result, the pinion is not unmeshed until the starter motor has come to a standstill. In the event of rapid repeated starting, the pinion is therefore either still meshed or at rest. The cause which leads to the first mentioned damage discussed above, i.e. a still rotating pinion striking a stationary ring gear, is thus excluded.

The second mentioned damage, which is caused by an attempt at meshing the already started internal combustion engine into a rotating ring gear, is also reduced. That is, after a successful start, the pinion does not unmesh until, due to the free-wheel between armature shaft and pinion, the armature shaft of the switched-off starter motor comes to a standstill and current no longer flows through the protection device. Provisional measurements show that the pinion remains meshed in the ring gear one to two seconds longer. During this time period, erroneous repeated starting in the running engine is possible without abrasion occurring at the ring gear.

A further advantage of the protection device according to the present invention resides in the fact that the time after which repeated starting can take place under the same initial conditions as a first start is shortened. The armature shaft of the starter motor is actually very rapidly braked by the coasting internal combustion engine. Normally, the pinion coasting time would be five to six times as long as the coasting time of the internal combustion engine. The shortening of the waiting time until possible repeated starting is also important for safety considerations since the traffic situation often requires rapid repeated starting.

Further advantages of the solution according to the present invention result from the structure hereinafter described. The protection device is realized in a very simple and robust manner by a stop armature with electromagnetic drive.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
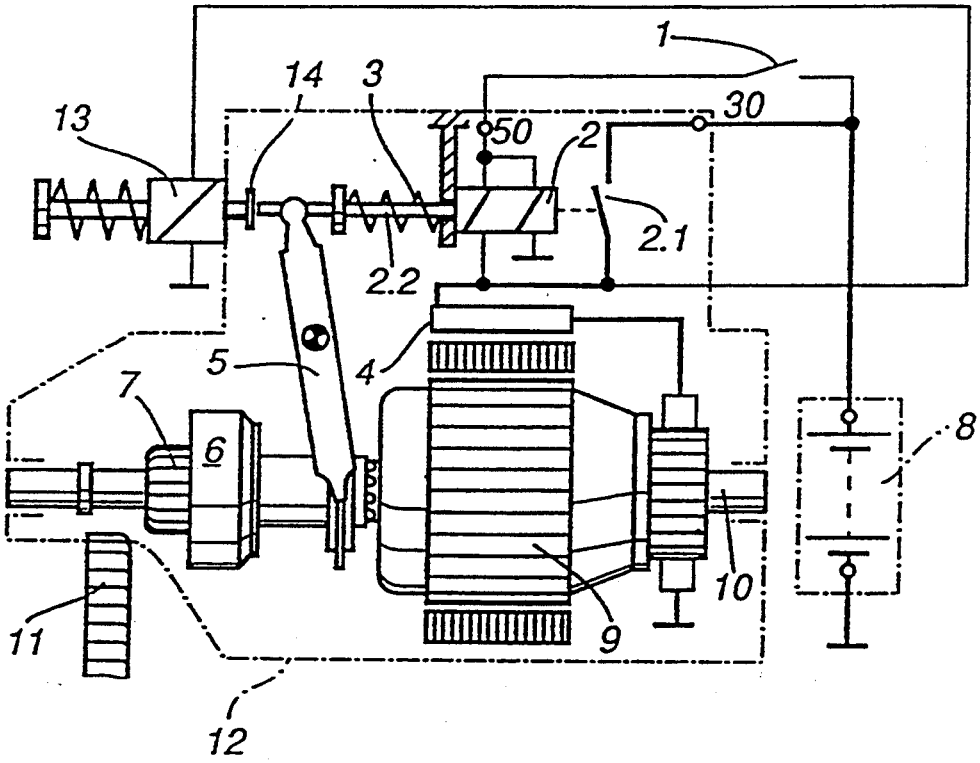
FIG. 1 is a schematic view of the starter according to the present invention in the position of rest.

FIG. 1 shows, inside the dot-dashed line which schematically represents a starter housing 12, a schematic illustration of a starter in a rest position such as is described in the above-mentioned publication DE-Z: BOSCH, Technische Unterrichtung: Startanlagen, 1984 (translation, Technical instruction aid: Starting systems), in particular at page 20. In this embodiment, the starter is a solenoid starter consisting of a starter motor 9 whose armature shaft 10 drives the pinion 7 via a free-wheel 6 which prevents the armature of the starter motor 9 from being accelerated to unacceptably high speeds of revolution as the starter motor starts.

The starter motor 9 is a D.C. series-wound motor in which the exciter winding 4 is connected in series to the armature winding of the starter motor 9. An engagement relay 2 with a pull-in winding and a holding winding is installed on the starter motor 9; the windings are connected, on one hand, via the clamp 50 to the starter switch 1 and, on the other hand, to the exciter winding 4 or to ground. Further components of the engagement relay 2 are the contact bridge 2.1 and the meshing armature 2.2. The contact bridge 2.1 is opened in the rest position and, in the closed position, closes the main circuit (bold line) in order to supply current to the starter motor 9. A pulling-in movement of the meshing armature 2.2, when current flows through the engagement relay 2, is transmitted by a meshing lever 5 to a screw-push mechanism for meshing the pinion 7.

Figure 4:
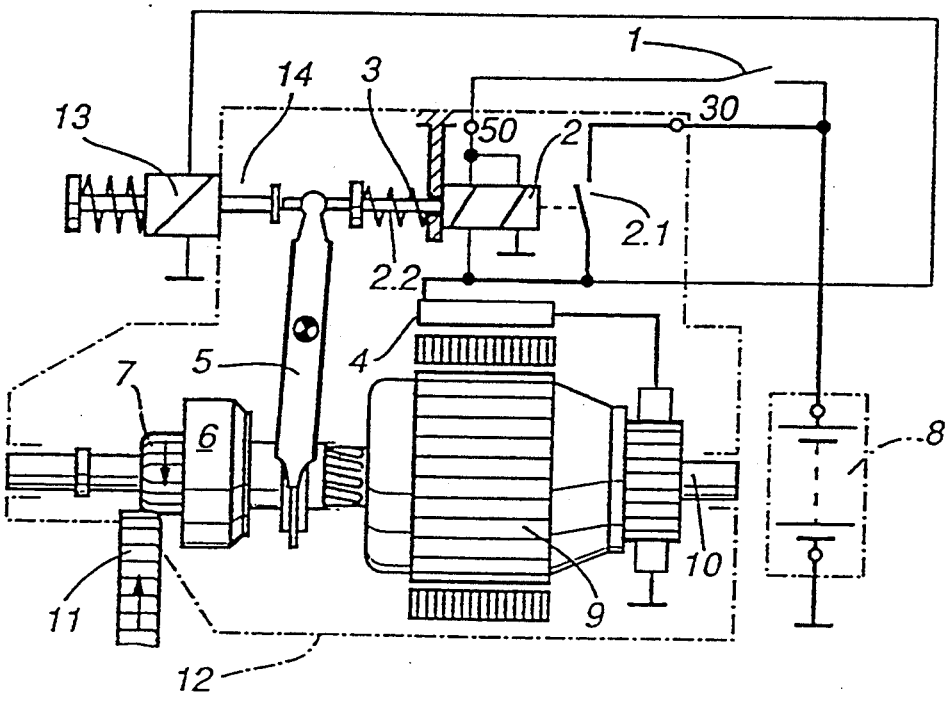
FIG. 4 is a schematic view of the starter of FIG. 1 but during unmeshing.

The protection device 13 according to the present invention consists of a stop armature 14 with an electromagnetic drive (winding) and automatic return (restoring spring). The protection device 13 is attached to the starter housing 12 (flanged on) such that the stop armature 14 counteracts a restoring movement of the retracted meshing armature 2.2 in the stop position, i.e. the stop armature 14 is extended when current flows through the protection device 13 (FIG. 4). The protection device 13 is electrically connected to the exciter winding 4 and is thus also supplied from the main circuit (bold line).

Figure 2:
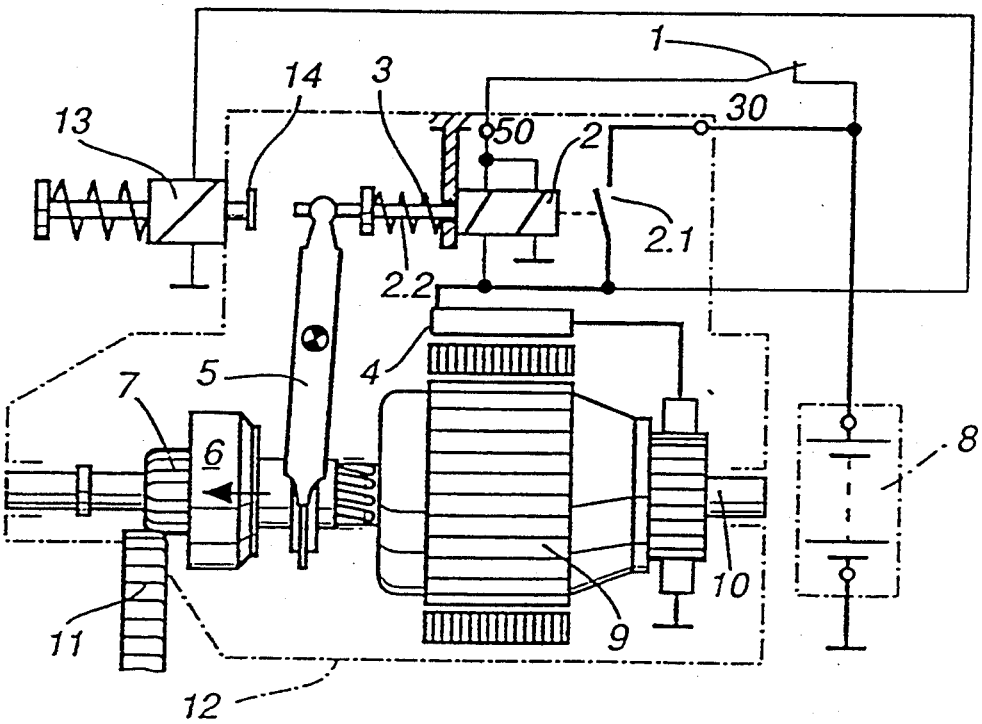
FIG. 2 is a schematic view of the starter of FIG. 1 but during meshing.
Figure 3:
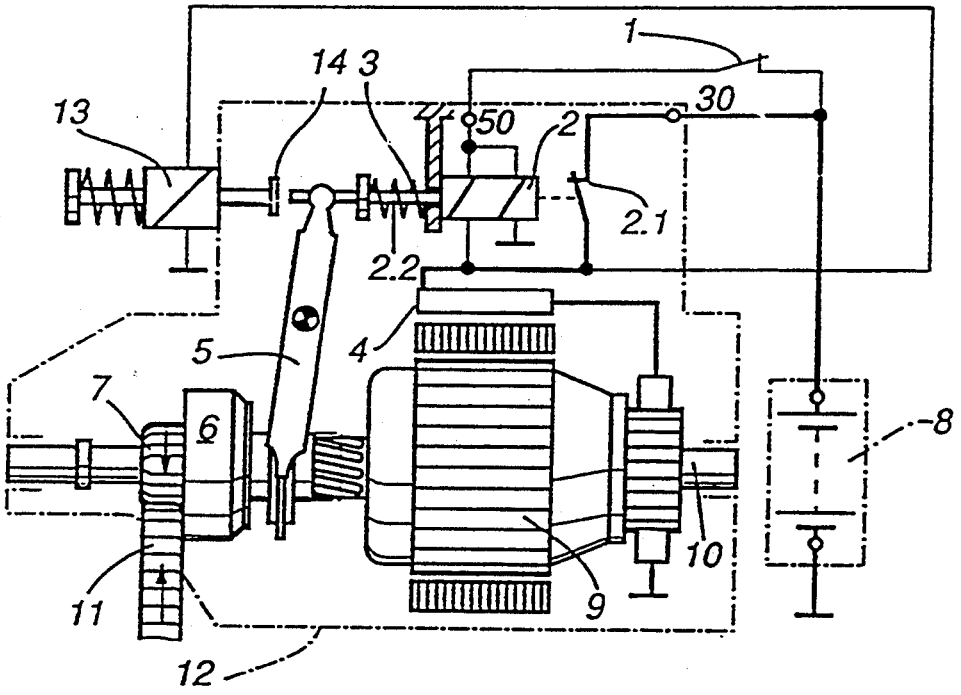
FIG. 3 is a schematic view of the starter of FIG. 1 but during turning.

Initially, the mode of operation of the starter, which is known per se, is explained with reference to FIGS. 2 and 3. In a starting process (FIG. 2), which is initiated with the closing of the starter switch 1, current flows through the pull-in winding and the holding winding of the engagement relay 2, whereupon the meshing armature 2.2 attracts the meshing lever 5 counter to the spring force of a restoring spring 3. The meshing lever 5 pushes the pinion 7 on the armature shaft 10 in the direction of the ring gear 11. As this occurs, the pinion 7 rotates forwards through the screw effect of a meshing gear until the pinion 7 is meshed into the ring gear 11 and comes to a stop.

In the final position of the meshing armature 2.2 (FIG. 3), the contact bridge 2.1 is closed. The main supply current (bold line) flows via the closed contact bridge 2.1 to the exciter winding 4 of the starter motor 9 which turns the internal combustion engine (not illustrated) via the pinion 7 which is now meshed into the ring gear 11. At the same time, with the closing of the contact bridge 2.1, the pull-in winding in the engagement relay 2 is short-circuited. Only the holding winding in the engagement relay 2 continues to be effective, with the weaker magnetic force of which engagement relay 2 being sufficient, however, to retain the meshing armature 2.2 in the retracted position until the termination of the starting process. If, in order to abort the starting process, the starter switch 1 is opened and the flow of current to the holding winding is eliminated, the meshing armature 2.2 yields to the spring force of the restoring spring 3 and returns to the position of rest, the contact bridge 2.1 being initially opened and the pinion 7 being subsequently unmeshed.

The protection device 13 according to the present invention intervenes in the described procedure. Specifically, in the rest position (FIG. 1), current is not flowing through the protection device 13 so that the stop armature 14 is in the rest position in which the meshing armature 2.2 also assumes its position of rest without impedance. Directly after the starter switch 1 has been actuated (FIG. 2), the protection device 13 is only weakly supplied by way of the current flowing through the windings of the engagement relay 2 and it is insignificant to what extent the stop armature 14 is extended thereby. Only after the pinion 7 has been meshed and the contact bridge 2.2 is closed (FIG. 3), is the protection device 13 supplied via the main current (bold line) which is sufficient to extend the stop armature 14 into the stop position. The stop position must, however, be dimensioned such that, when the starter switch 1 is opened (FIG. 4), the meshing armature 2.2 can yield to the restoring spring 3 without impedance to such an extent that the contact bridge 2.1 is opened immediately. Thus, although the main current supply for the starter motor 9 and the protection device 13 are disconnected, as long as the armature shaft 10 is still coasting and has not come to a standstill, a voltage is induced in the exciter winding 4 to hold the stop armature 14 in the stop position. Thus, for the coasting time of the starter motor 9, the meshing armature 2.2 is held in an intermediate position in which the pinion 7 is still meshed into the ring gear 11.

The foregoing has the following effect depending on whether the attempt at starting was successful or not. In the event of a false start, the internal combustion engine comes to rest very quickly and synchronously also brakes the armature shaft 10 of the starter motor since the pinion 7 and ring gear 11 are in engagement. The pinion 7 is not unmeshed from the engagement relay 10 until the flow of current to the protection device 13 has stopped and its stop armature 14 has returned to the rest position. The protection device 13 therefore brings about, on one hand, a shortening of the pinion coasting time and on the other hand ensures that the pinion is not unmeshed until the internal combustion engine and the starter motor 9 have come to a standstill. Afterwards, the same initial conditions prevail as for initial starting.

In the event of a successful attempt at starting, the internal combustion engine achieves independent running, after which the free-wheel 6 releases the frictionally engaging connection between the armature shaft 10 and crankshaft of the internal combustion engine as soon as the speed of revolution of the engine is higher than the speed of revolution of the starter. The armature shaft 10 therefore coasts slowly braked by frictional forces, during which the pinion 7 and the ring gear 11, decoupled from the armature shaft 10 by the free-wheel 6, are in engagement. The protection device 13 thus has the effect that, during this free coasting time of the armature shaft 10, repeated starting in the running internal combustion engine can be attempted without causing damage.

The protection device 13 does not offer any protection in the event of repeated starting in the running internal combustion engine if some time has already passed and the pinion 7 is unmeshed from the ring gear 11. During meshing, the pinion 7 would then strike a rotating ring gear 11 and the abrasion mentioned above would occur. In practice, this case is of lesser significance, since the more time the driver takes the more reliably can he detect whether the internal combustion engine has started.

Nevertheless, the protection device can be extended without difficulty to the extent that a signal of a current generator which is driven by the internal combustion engine is evaluated in order to block the starter in the event of independent running. The particular expenditure resulting from an additional feeding of power may not, however, be justified in view of the already satisfactory performance of the protection device 13 according to the present invention which constitutes an optimum compromise between the required protective function and the degree of expenditure required to achieve that function.

A protection device according to the invention can also be realized such that the associated electromagnetic drive is integrated into the engagement relay 2 in the form of a third winding. The stop armature can be configured as a tube which is terminated at the front and in which the meshing armature 2.2 moves, the front termination of the tube serving as a stop. In order not to be influenced by the other windings in the engagement relay 2, the tube must be produced from non-magnetic material in the corresponding region.

A voltage which is brought about by rotation of the armature shaft 10 for the purpose of driving the protection device 13 can, of course, also be provided other than by tapping off the voltage induced in the exciter winding 4. For example, the voltage induced in an auxiliary winding of the starter motor can also be used.

A protection device according to the invention provides, in addition to the lower costs, the advantage that it can be installed directly onto the starter without further external feedlines. Thus, vehicles can be retrofitted without difficulty by simply replacing the existing starter with the starter according to the present invention.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A system including a starter and protection device for protecting an internal combustion engine against damage, comprising a starter switch for initiating a starting operation, an electric starter motor with an armature shaft, a pinion arranged relative to the armature shaft such that in the course of the starting operation, the pinion is advanced on the armature shaft by an engagement relay and is meshed into a ring gear of the internal combustion engine, and a contact bridge for supplying main current to the starter motor is operatively arranged to be closed by a meshing armature of the engagement relay, wherein a voltage induced by the rotation of the armature shaft of starter motor when coasting is supplied, after an aborted starting attempt when the starter switch is opened and the main current supply of the starter motor is disconnected, and means for holding, after an aborted attempt at the voltage induced by the rotation of the coasting armature shaft is supplied to the system, with the contact bridge remaining disconnected.

2. The system according to claim 1, wherein said means includes a stop armature and a winding operatively associated therewith such that, when current flows through the latter, the stop armature is moved into a position to counteract a return of the meshed armature, caused by a restoring spring associated therewith, into its initial position such that the pinion is still meshed in the ring gear and the contact bridge for switching the main supply of the starter motor is disconnected.

3. The system according to claim 1, wherein the starter motor is a series-wound D. C. motor, and the voltage for driving the protection device is tapped off on an input side on an exciter winding of the starter motor.

* * * * *